US006619790B1

(12) United States Patent
Lui et al.

(10) Patent No.: US 6,619,790 B1
(45) Date of Patent: Sep. 16, 2003

(54) INK-JET PRINTER CARTRIDGE UPPER COVER

(75) Inventors: Pui Kuong Lui, Kowloon (HK); Yiu Cheong Law, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 11 days.

(21) Appl. No.: 10/093,421

(22) Filed: Mar. 11, 2002

(51) Int. Cl.[7] ..... B41J 2/175
(52) U.S. Cl. ..... 347/86
(58) Field of Search ..... 347/85, 86, 87; 215/307, 341, 346; 137/43, 247.41, 384

(56) References Cited

U.S. PATENT DOCUMENTS 4,871,077 A * 10/1989 Ogden et al. ..... 215/307
5,949,461 A * 9/1999 Jones et al. ..... 347/87
6,132,036 A * 10/2000 Abe et al. ..... 347/86
6,273,562 B1 * 8/2001 Deshmukh ..... 347/86
6,276,788 B1 * 8/2001 Hilton ..... 347/86

* cited by examiner

*Primary Examiner*—Anh T. N. Vo
(74) *Attorney, Agent, or Firm*—Rosenberg, Klein & Lee

(57) ABSTRACT

An ink-jet printer cartridge upper cover includes an inner tube, an outer tube, a non-rigid sealing ring defining a hole at the center portion thereof, and a vent-tip forming a cavity about the bottom surface thereof and having an air passageway extending from the bottom surface of said cavity through the hole, the upper cover inner tube, and said upper cover outer tube. Inner surface of the non-rigid sealing ring hole engages with outer surface of the upper cover inner tube, and outer surface of the hole engages with the inner surface of the cavity.

7 Claims, 3 Drawing Sheets

INK-JET PRINTER CARTRIDGE UPPER COVER

BACKGROUND OF THE INVENTION

1. Field of the Invention

The present invention relates to an ink-jet printer cartridge upper cover, and more particularly, to an ink-jet printer cartridge upper cover with the setting of a non-rigid sealing ring for the purpose of sealing with other portions of the upper cover to prevent the ink from leakage.

2. Description of the Prior Art

Please refer to FIG. 1 of a cross sectional view of a prior art ink-jet printer cartridge upper cover 12. The ink-jet printer cartridge upper cover 12 engages with a vent-tip 13. The upper cover 12 further includes an opening 15, and the vent-tip 13 also includes an air passageway 16. For the purpose of communicating the ambient air outside the ink-jet printer cartridge upper cover 12 and the air inside of it the vent-tip 13 further includes another opening 18 located at the top end of the air passageway 16. The setting of protruded portion 19 protruded around and from the surface of the vent-tip 13 is for the engagement of the vent-tip 13 with the upper cover 12. The protruded portion 19 is designed to prevent the ink from leaking through the opening 15 of the upper cover 12. However, the protruded portion 19 may be rubbed to a level due to the friction with the upper cover 12 once it is going to engage with the upper cover 12, thus leading to some gaps between the protruded portion 19 and the upper cover 12. As this result, the original purpose of setting the protruded portion 19 will be undermined, and that is why the leakage of the inkthrough the opening 15 may occur under this kind of condition.

SUMMARY OF THE INVENTION

It is therefore a primary objective of the present invention to provide an ink-jet printer cartridge upper cover with a non-rigid sealing ring for the purpose of sealing with other portions of the ink-jet printer cartridge upper cover tightly. In other words, the non-rigid sealing ring is like a buffer between the upper cover and the vent-tip, and, additionally, because of setting of this detachable non-rigid sealing ring, the entire manufacturing process is improved in the time and labor cost wise.

In accordance with the claimed invention, an ink-jet printer cartridge upper cover includes an inner tube, an outer tube, a non-rigid sealing ring defining a hole at the center portion thereof, and a vent-tip forming a cavity about the bottom surface thereof and having an air passageway extending from the bottom surface of the cavity through the non-rigid sealing ring hole, the upper cover inner tube, and the upper cover outer tube. Inner surface of the non-rigid sealing ring hole engages with the outer surface of the upper cover inner tube, and the outer surface of the hole engages with the inner surface of the cavity.

It is an advantage of the present invention that addition of detachable non-rigid sealing ring not only seals with other portions of the upper cover very tightly to prevent any ink leakage, but accelerate the entire manufacturing flow while integrating the non-rigid sealing ring into the upper cover.

These and other objectives of the present invention will no doubt become obvious to those of ordinary skill in the art after reading the following detailed description of the preferred embodiment illustrated in the various figures and drawings.

DETAILED DESCRIPTION OF THE PREFERRED EMBODIMENT

Figure 1:
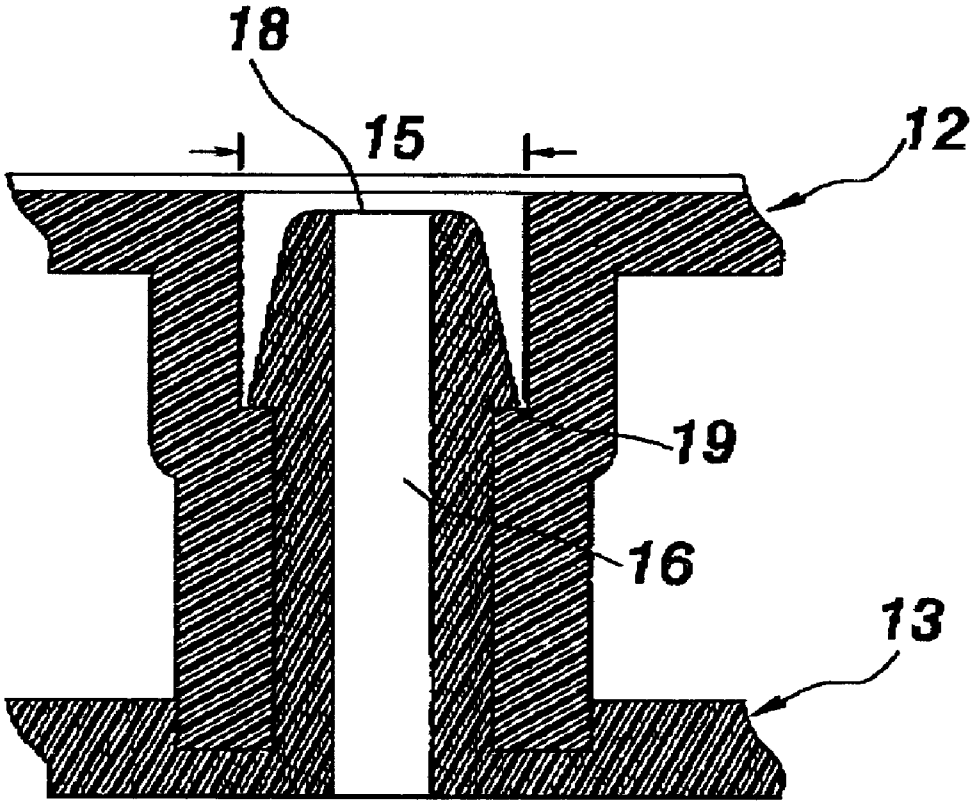
FIG. 1 PRIOR ART
FIG. 1 is a cross-sectional view of a portion of a prior art ink-jet printer cartridge upper cover.
Figure 2:
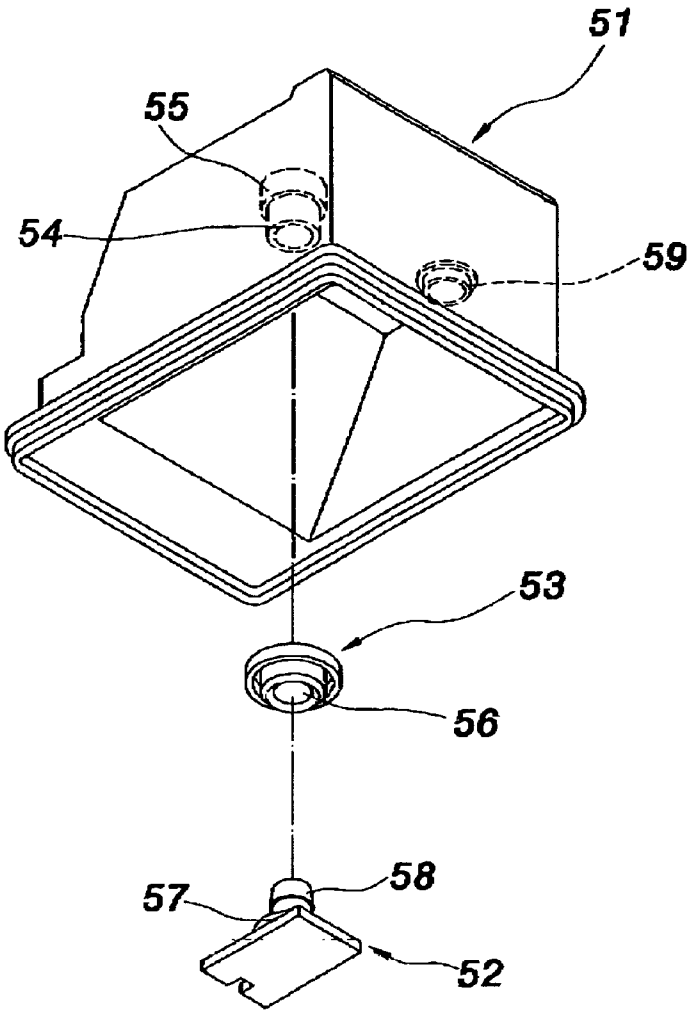
FIG. 2 is a schematic diagram of an ink jet printer cartridge upper cover according to the present invention.

Please refer to FIG. 2 of a schematic diagram of an ink-jet cartridge upper cover 51 according to the present invention. The present invention upper cover 51 includes a vent-tip 52, and a detachable non-rigid sealing ring 53.

The upper cover 51 further includes an inner tube 54 and an outer tube 55, and the non-rigid sealing ring defines a hole 56 at the center portion of itself. While combining the upper cover 51 and the non-rigid sealing ring 53 together, for the purpose of preventing the ink from leakage, the outer surface of the inner tube 54 engages with the inner surface of the hole 56. The vent-tip 52 includes a cavity 57 extends from the bottom surface of itself, and an air passageway 58 extends from the cavity 57 and is long enough to pass through the hole 56 of the non-rigid sealing ring, the inner tube 54 and the outer tube 55. Furthermore, the outer surface of the hole 56 engages with the inner surface of the cavity 57. As this result, while the inner tube 54, the outer tube 55, the vent-tip 52, and the non-rigid sealing ring 53 combine with each other, the goal of preventing the ink leakage can be reached. Moreover, the upper cover 51 further includes an ink injection opening 59 punched through the top surface of itself for the purpose of injecting the ink. The depth of the cavity 57 is substantially equal to the height of the non-rigid sealing ring 53. Base on this design, the vent-tip 52 can seal with the non-rigid sealing ring 53 more tightly.

Figure 3:
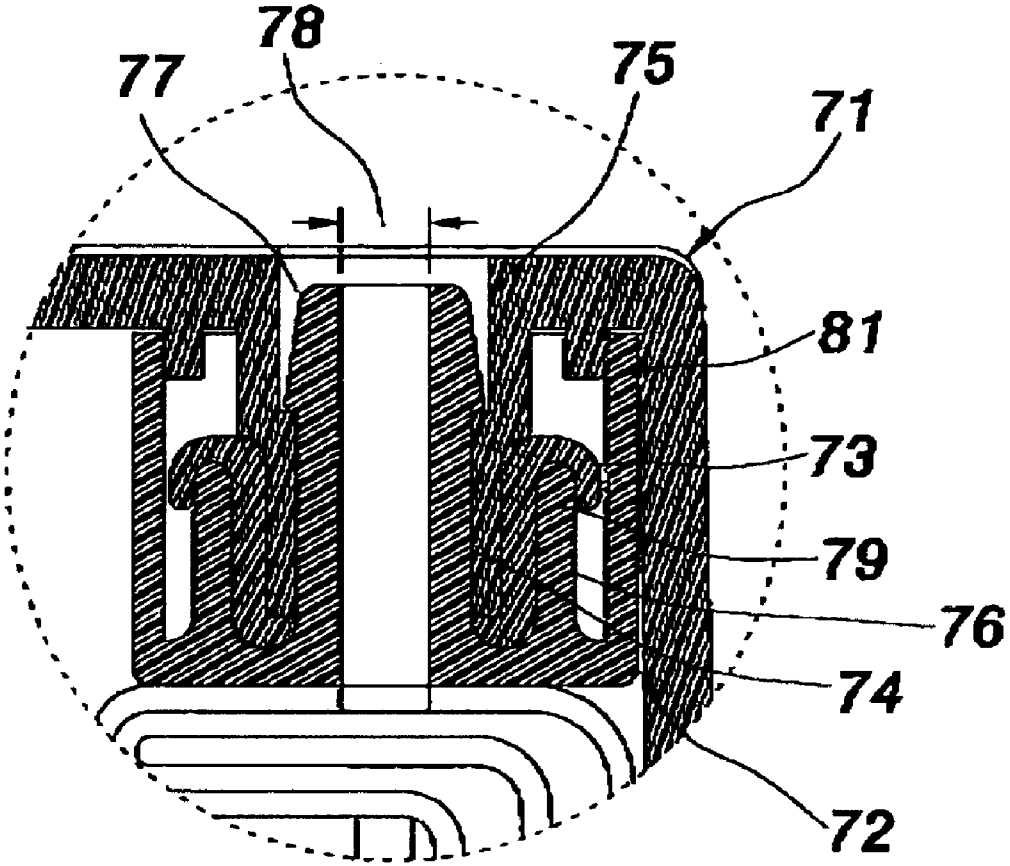
FIG. 3 is a cross-sectional view of a present invention ink-jet printer cartridge upper cover.

Please refer to FIG. 3 of a cross-sectional view of a present invention ink-jet printer cartridge upper cover 71. The upper cover 71 engages with a vent-tip 72 and a non-rigid sealing ring 73.

The upper cover 71 includes an inner tube 74 and an outer tube 75, and the vent-tip 72 includes a cavity 76 extends from the bottom surface thereof. The upper cover 71, the vent-tip 72, and the non-rigid sealing ring 73 engage with each other very tightly for the purpose of preventing the ink leakage. The vent-tip 72 also includes an air passageway 77 for passing the air in an air bag (not shown in this figure) and the ambient air outside the upper cover 71. Both the air in the air bag and the ambient air outside the upper cover 71 pass through an opening 78 of the upper cover 71. The vent-tip 72 also includes an inner collar 79 and an outer collar 81, each of which engages with the non-rigid sealing ring 73 and the upper cover 71 respectively. The setting of the inner collar 79, which is monolithically disposed around the cavity 76, and the outer collar 81 are to enhance the sealing between the upper cover 71, the vent-tip 72, and the non-rigid sealing ring 73, which can be a silicon rubber, is tight enough to prevent any ink leakage. Generally speaking, the inner collar 79 can be regarded as an "outer wall" of the cavity 76.

In comparison with prior arts, the present invention provides a detachable non-rigid sealing ring for engaging with other constituting parts of an ink-jet printer cartridge upper cover. The setting of non-rigid sealing ring is for the purpose of sealing with other portions to a tighter level to prevent any ink leakage. As this result, the additional gaps shown in prior art cartridge upper covers because of the rubbing again and again between the vent-tip and the upper cover while integrating both of them can be avoided. Thus, the occurrence of ink leakage can be reduced. In other words, the present invention provides a non-rigid sealing ring not only functions as a buffer located between the upper cover and the vent-tip, but ensures the sealing between the sealing ring and the upper cover and the vent-tip is tight enough to prevent any ink leakage.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink-jet printer cartridge upper cover, comprising:

an upper cover inner tube;

an upper cover outer tube;

a non-rigid sealing ring defining a hole at a center portion thereof; and a vent-tip forming a cavity about a bottom surface thereof and having an air passageway extending from the bottom surface of said cavity through said non-rigid sealing ring hole, said upper cover inner tube, and said upper cover outer tube;

wherein an inner surface of said non-rigid sealing ring hole engages with the outer surface of said upper cover inner tube, and an outer surface of said hole engages with an inner surface of said cavity.

2. The ink-jet printer cartridge upper cover of claim 1 wherein said upper cover outer tube contacts with said non-rigid sealing ring while said upper cover inner tube, said non-rigid sealing ring, and said vent-tip engage with each other.

3. The ink-jet printer cartridge upper cover of claim 1 wherein said non-rigid sealing ring is formed of a silicon rubber.

4. The ink-jet printer cartridge upper cover of claim 1 wherein a height of said non-rigid sealing ring is substantially equal to a depth of said cavity.

5. The ink-jet printer cartridge upper cover of claim 1 further comprising an injection opening for injecting ink.

6. The ink-jet printer cartridge upper cover of claim 1 wherein said vent-tip further comprises an inner collar for sealing with said non-rigid sealing ring and an outer collar for sealing with said upper cover outer tube.

7. The ink-jet printer cartridge upper cover of claim 6 wherein said inner collar is monolithically disposed around said cavity.

* * * * *